United States Patent [19]

Fischer

[11] Patent Number: 4,654,613

[45] Date of Patent: Mar. 31, 1987

[54] RADAR ROTARY JOINT

[75] Inventor: Clifford W. Fischer, Englewood, Colo.

[73] Assignee: Texas Instruments Incorporated, Dallas, Tex.

[21] Appl. No.: 761,718

[22] Filed: Aug. 2, 1985

[51] Int. Cl.[4] ..... H01P 1/06

[52] U.S. Cl. ..... 333/256; 333/21 R

[58] Field of Search ..... 333/21 R, 256, 257, 333/249

[56] References Cited

U.S. PATENT DOCUMENTS

| | | | |
|---|---|---|---|
| 2,632,806 | 3/1953 | Preston | 333/256 X |
| 2,914,741 | 11/1959 | Unger | 333/249 |
| 3,715,688 | 2/1973 | Woodward | 333/256 X |

OTHER PUBLICATIONS

Beck, *Measurement Techniques for Multimode Waveguides*, Proc. of Symposium on Modern Advances in Microwave Techniques, New York, Nov. 1954.

*Primary Examiner*—Paul Gensler

*Attorney, Agent, or Firm*—Richard K. Robinson; Leo N. Heiting; Melvin Sharp

[57] ABSTRACT

A radar rotary joint usable at all frequencies, but particularly useful at millimeter wavelengths includes an inner housing, an outer housing, bearings for rotatably interconnecting the inner and outer housing, and irises for converting the mode of incoming and exiting electromagnetic energy. The inner housing has a $TE_{11}$ mode circular waveguide, a $TM_{01}$ mode circular waveguide and a right angle transition for converting the $TE_{11}$ mode to $TM_{01}$ mode and an outer surface forming a bearing support, an outer bearing housing for enclosing the bearings and bearing retainers for retaining the bearings between the outer bearing housing and the bearing supporting surface of the inner housing. The outer housing is attached to the outer bearing housing and includes a $TM_{01}$ mode circular waveguide, a $TE_{11}$ mode circular waveguide and a right angle transition for converting the $TM_{01}$ mode to the $TE_{11}$ mode. An inline junction input iris attached between a $TE_{10}$ rectangular waveguide feed and $TE_{11}$ circular waveguide converts the $TE_{10}$ mode to the $TE_{11}$ mode, and an inline junction output iris converts the $TE_{11}$ mode of the circular waveguide of the outer housing to the $TE_{10}$ mode of a connecting rectangular waveguide.

9 Claims, 10 Drawing Figures

CIRCULARLY SYMMETRIC MODES

1. CROSS - SECTIONAL VIEW
2. LONGITUDINAL VIEW
3. SURFACE VIEW

RADAR ROTARY JOINT

BACKGROUND OF THE INVENTION

This invention relates to radars and more particularly to a rotary joint applicable for all frequencies and to millimeter wavelengths, in particular.

Rotary joints provide a continuous microwave transmission path between rotating and stationary sections of a mechanically scanned antenna system. They must operate over the scan range of the radar system with minimum distortion of the microwave signal. To do this, the voltage standing wave ratio (VSWR) (reflection) and insertion loss of a rotary joint needs to be minimized and have minimal variation with rotation over the desired frequency band.

Microwave energy propagates in waveguide only in particular modes FIGS. 1*a* and 1*b*. In rectangular waveguide, used for transmission paths in most radar systems, the energy propagates in the dominant $TE_{10}$ (transverse electric wave). For rotary joints, this energy must first be converted to a circularly symmetric mode and waveguide (circular tube or coaxial line). A circularly symmetric mode implies that the orientation of the E (electric) and H (magnetic) field patterns in the waveguide make the modes independent of rotation. In the circular tube, a break between rotating and stationary parts of the rotary joint can be made with a small gap RF choke providing electrical continuity at the break. At the output of the rotary joint a conversion back to the $TE_{10}$ in rectangular waveguide is needed. Those persons skilled in the art desiring more information about a rotary joint with a small gap RF choke are referred to "Radiation Laboratory Series #9—Microwave Transmission Circuits", George L. Ragan, pp. 193–199.

In the past (FIG. 2), rotary joints have used a right angle transition from the $TE_{10}$ mode in rectangular waveguide to the $TM_{01}$ mode in circular waveguide. A circular hole has been cut in the broad wall of the rectangular waveguide the same diameter as the desired circular waveguide and the two waveguides are attached. The size of the circular waveguide is chosen to propagate the $TM_{01}$ mode at the design frequency but small enough to be in the non-propagating region of any higher order modes. Shorting stubs are inserted in the open ends of the rectangular waveguides.

The shape and position of these stub "tunes" the rotary joint to operate in the desired frequency band. The higher the frequency the smaller the parts become. For example, rectangular waveguide used in the 12–18 GHz range has a width of 0.622 inches wide compared to 0.100 inches for waveguide used at 94 GHz. Surface finish inside the waveguide becomes more critical at higher frequencies since the wavelength of the energy becomes proportionally smaller. The rectangular to circular waveguide right angle transition would be difficult and expensive to build at millimeter wavelengths.

The same fabrication techniques and design principles used at lower frequencies can not be used to build an inexpensive millimeter wave rotary joint. Most millimeter wave components are made out of expensive coin-silver or plated materials which are necessary to keep losses low at these high frequencies. Intricate components can be made using electro-forming, casting, or other similar techniques, but all are expensive processes and some final machining operations would still be necessary for rotary joint parts.

In addition to the mechanically scanned antenna, conical scan or twist reflector type antenna systems have been studied for radar systems operating at millimeter wave frequencies (above 40 GHz). These systems are less efficient in performance and are more costly.

SUMMARY OF THE INVENTION

Accordingly it is an object of this invention to provide an efficient, high performance and low cost rotary joint for a mechanically scanned millimeter wavelength radar system.

Another object of the invention is to provide a rotary joint which is capable of operation at substantially all microwave frequencies.

A further object of the invention is to provide a compact easy to manufacture rotary joint having low production costs.

Briefly stated the rotary joint of this invention includes converting the $TE_{10}$ mode in rectangular waveguide to the $TE_{11}$ mode in a stationary circular waveguide, converting the $TE_{11}$ mode to the $TM_{01}$ mode in a rotating circular waveguide and converting the $TM_{01}$ back to the $TE_{10}$ mode in a rectangular waveguide.

DESCRIPTION OF THE DRAWINGS

Other objects and features of the invention will become more readily apparent from the following detailed description when read in conjunction with the accompanying drawings in which.

DESCRIPTION OF THE PREFERRED EMBODIMENT

Figure 1A:
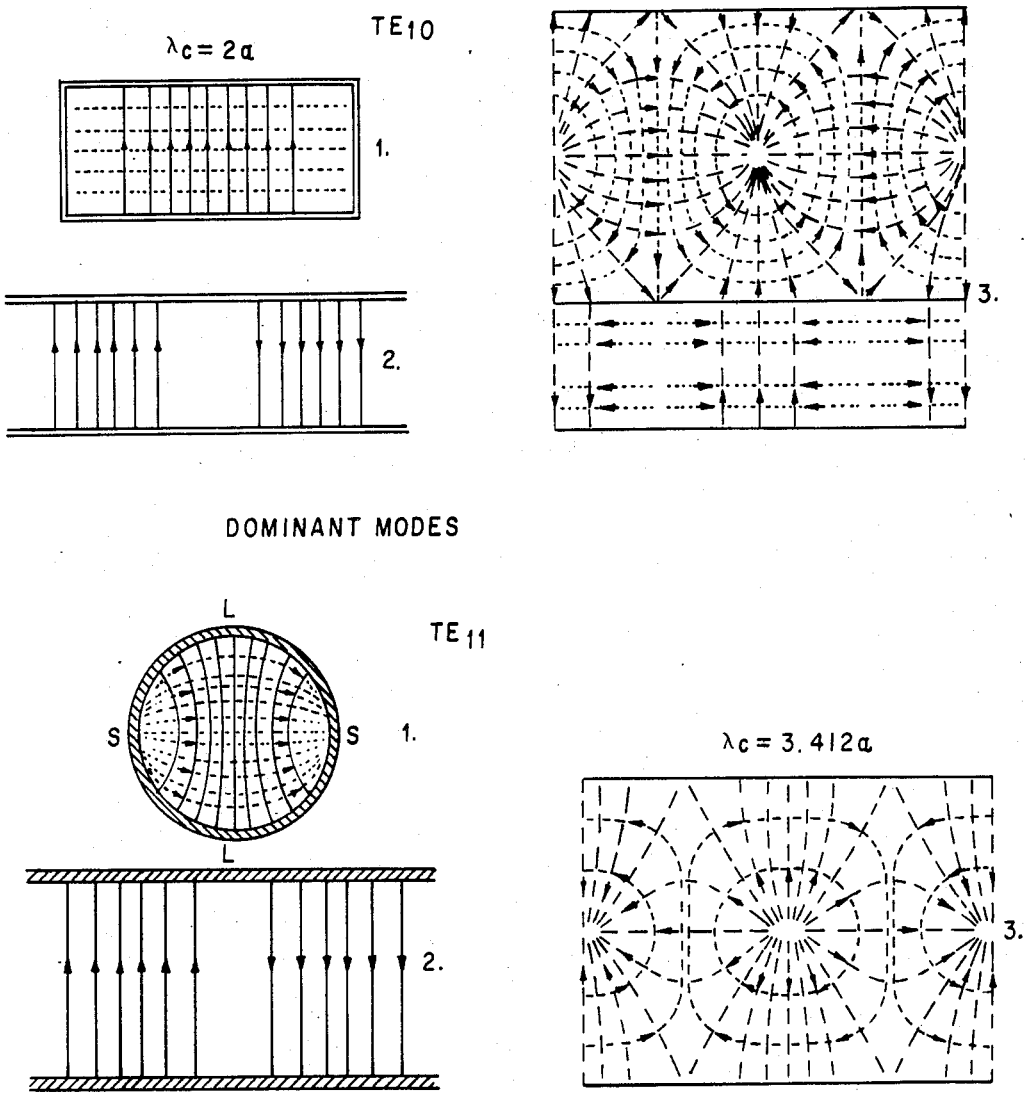
FIGS. 1*a* and 1*b* are views showing the rectangular and circular waveguide modes used in rotary joints.
Figure 1B:
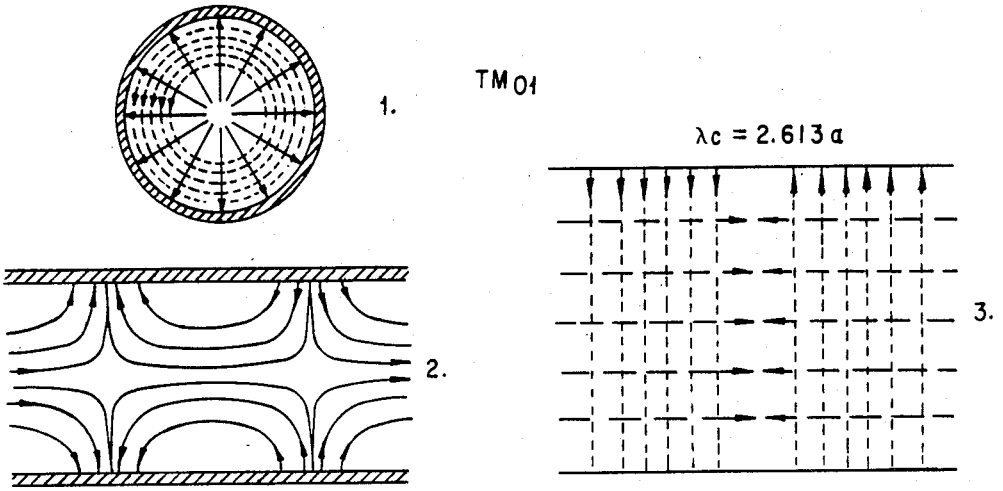
Figure 1B:
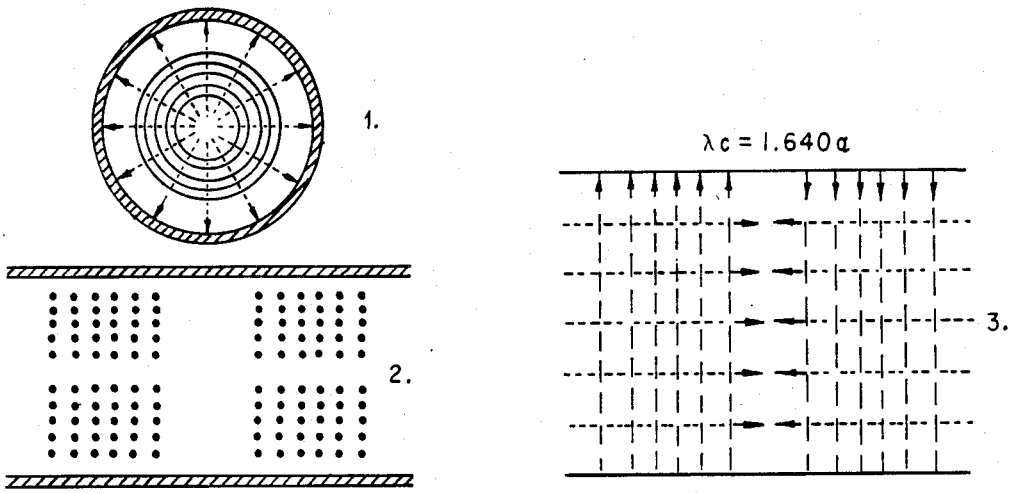
Figure 2:
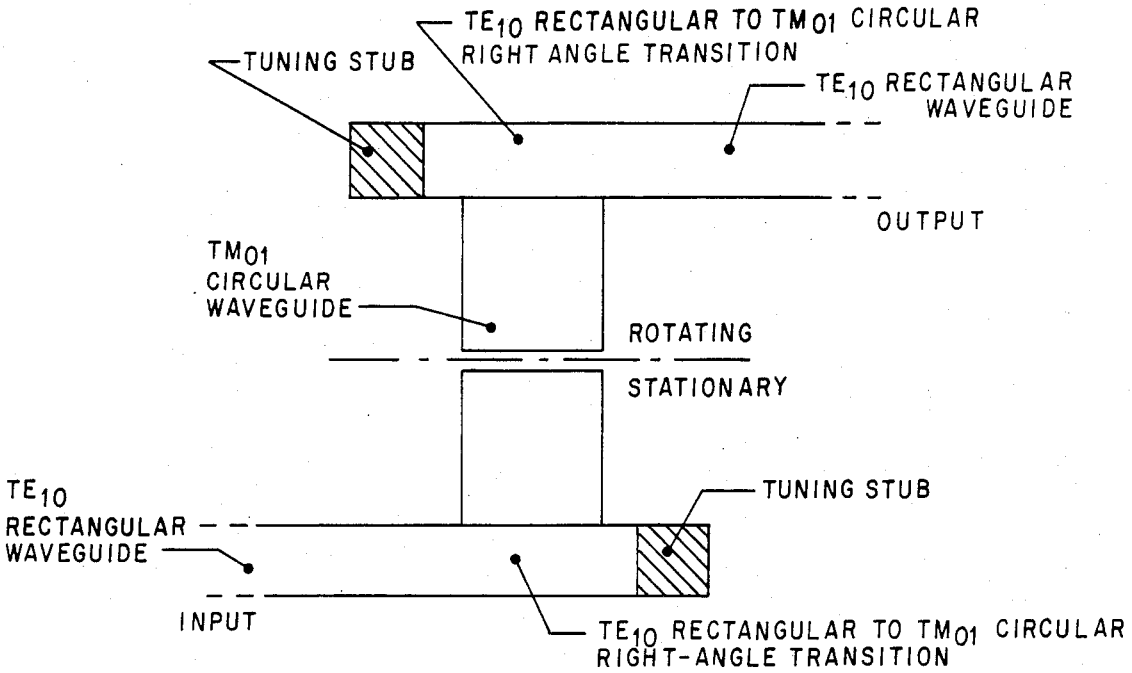
PRIOR ART Fig. 2
FIG. 2 is a view of a prior art rotary joint for a mechanically scanned radar system.

Referring now to the drawings, FIGS. 1*a* and 1*b* show the rectangular and circular waveguide modes ($TE_{10}$, $TE_{11}$, $TE_{01}$ and $TM_{01}$) used in rotary joints. These modes are those referred to throughout the following description.

Figure 3:
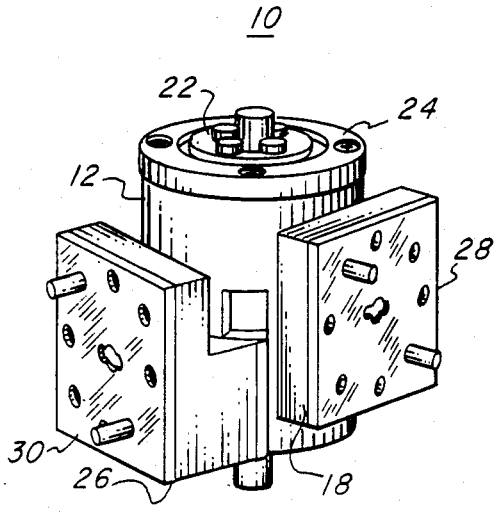
FIG. 3 is an isometric view of the rotary joint of the present invention.
Figure 4:
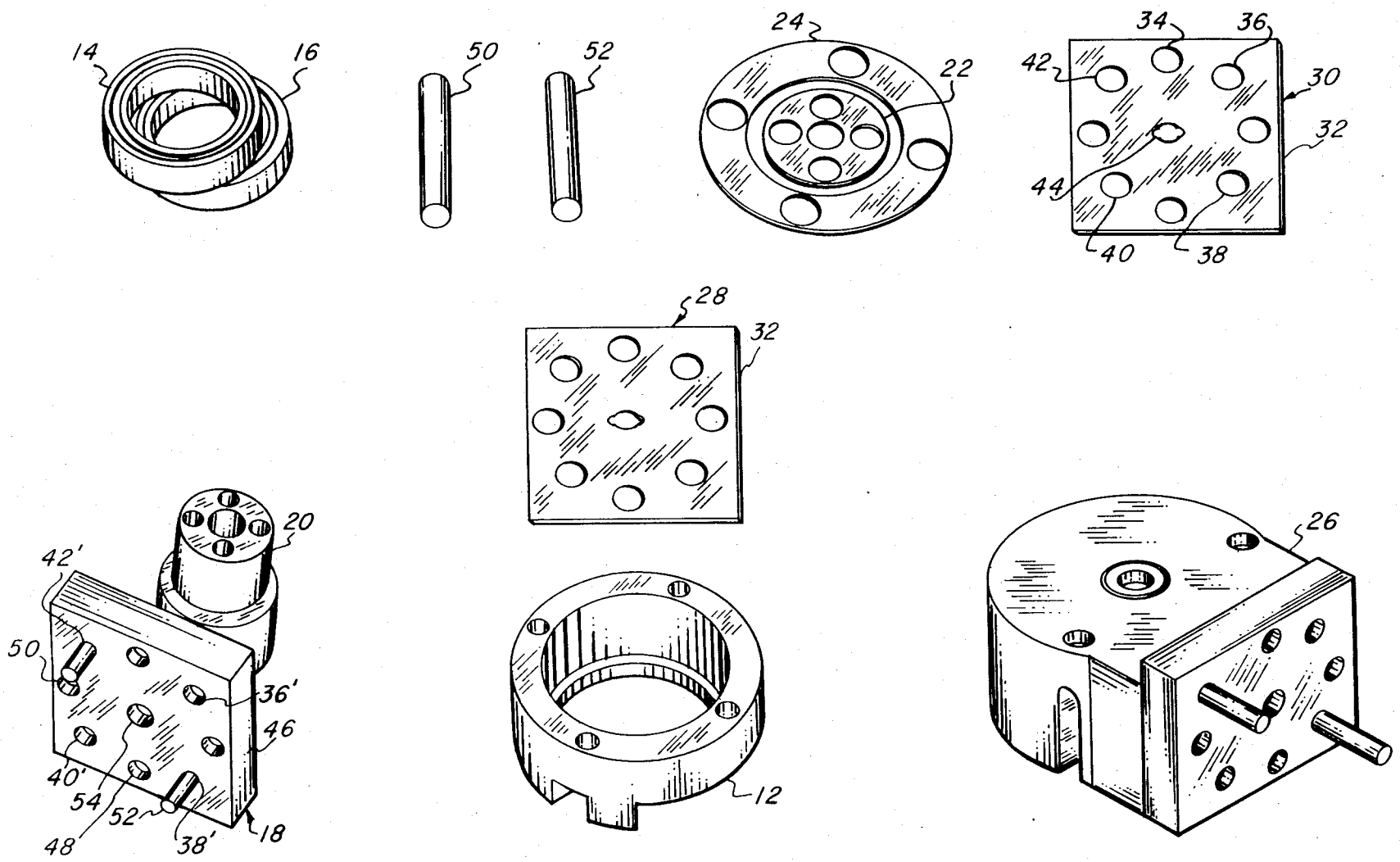
FIG. 4 is an exploded view of the rotary joint of FIG. 3.

Referring now to FIGS. 3 and 4, the rotary joint 10 (FIG. 3) comprises an outer bearing housing 12 in which is mounted ball bearing races 14 and 16 (FIG. 4). An inner housing 18 (FIGS. 3 & 4) has an inner bearing housing portion 20 (FIG. 4) which coacts with the outer bearing housing and bearing retaining member 22 attached to the outer end of the inner bearing housing and bearing retaining member 24 attached to the outer end of outer bearing housing 12 to retain the bearing races 14 and 16 between the outer bearing housing 12 and inner housing portion 20 of inner housing 18. An electrical outer housing 26 is rigidly attached to the bearing outer housing 12. Transition irises 28 and 30 (FIGS. 3 & 4) are connected, respectively, to outer ends of the inner housing 18 and outer housing 26 to complete the rotary joint. The outer ends of the inner and outer housings and transition irises are configured to match rectangular waveguide sections.

By way of example only and not for purposes of limitation a 94 GHz rotary joint will now be described. The transition irises 28 and 30 (FIG. 4) are identical in construction; therefore, only one need be described. The transition irises include a 0.700 inch square aluminum plate 32 having a 0.038 inch thickness, four 0.116 inch diameter holes 34 and four 0.067 inch diameter holes, 36, 38, 40 and 42 for accommodating mechanical connector means hereinafter described. The iris 44 consists of an 0.082 inch diameter center hole and two 0.052 inch diameter holes having centers positioned 0.031 inches horizontally left and right of the center point of the center hole to form the iris shaped as shown in FIG. 4.

The inner housing 18, which is preferably an aluminum housing, (FIG. 4) has a square flange block 46 which corresponds to the transition iris 28 in that it has four 0.116 inch diameter holes 48 which are threaded to receive rectangular waveguide connecting bolts and four 0.067 inch holes 36', 38', 40' and 42'. Holes 38' and 42' contain connecting dowels 50 and 52 and holes 36' and 40' are adapted to receive corresponding dowels of the rectangular waveguide (not shown). A 0.116 inch diameter center hole 54 forms the entrance to $TE_{11}$ circular waveguide section 56.

Figure 5:
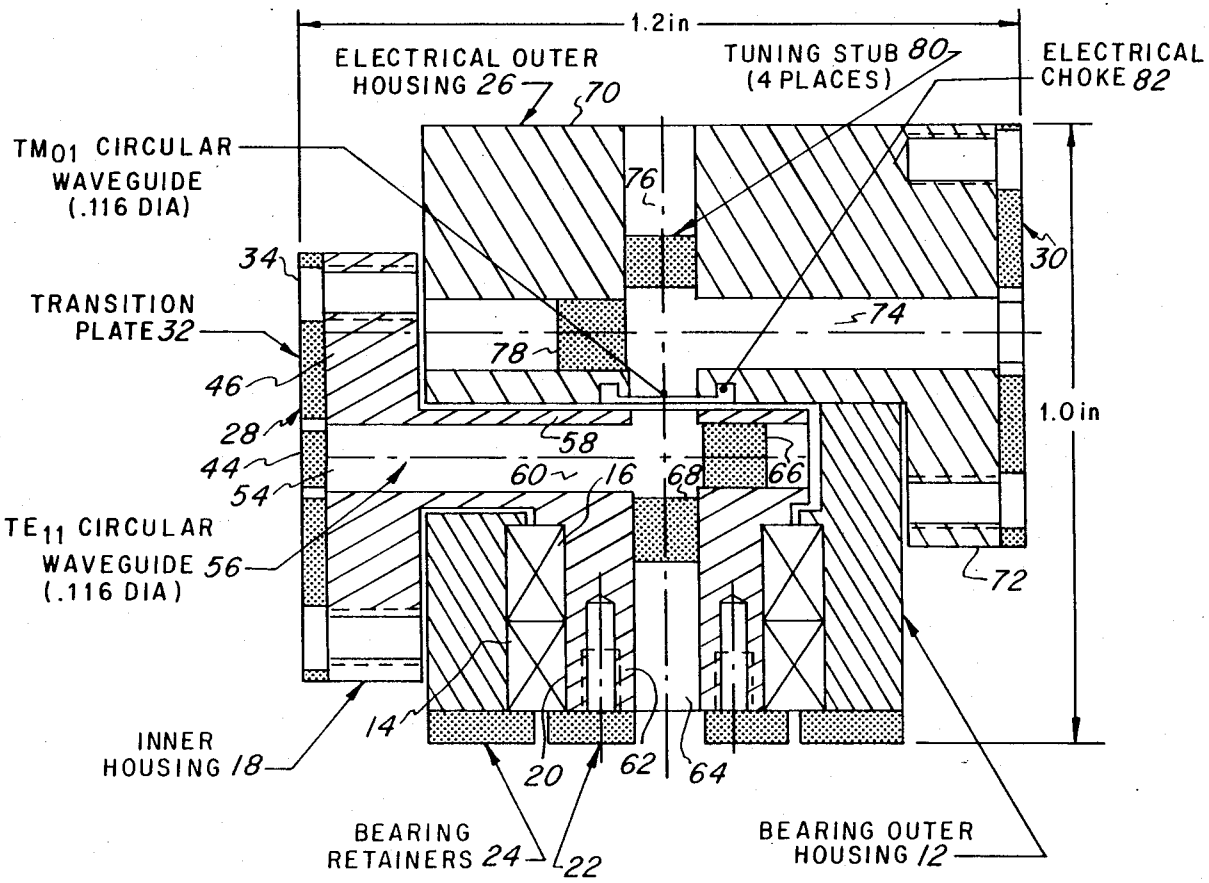
FIG. 5 is a cross-sectional view of FIG. 3.

The circular waveguide section 56 (FIG. 5) includes a tubular portion 58 forming a 0.116 inch diameter horizontally disposed passage 60 and a tubular portion 62 forming a corresponding vertically (90 degrees) disposed circular passage 64. The passages 60 and 64 intersect. Circular tuning stubs 66 and 68 having flat ends are provided adjacent the intersection of the passages 60 and 64 and are properly adjusted for RF tuning. The outer surface tubular portion 62 is recessed to form a seat for the roller bearing races 14 and 16 (FIG. 4).

The electrical outer housing 26 (FIGS. 4 & 5) is preferably an aluminum, truncated circular block 70. The flat or truncated surface is integral with a square transition iris supporting block 72. Block 72 has a portion depending from the circular block 70. Block 70 has a horizontal 0.116 inch diameter circular passage 74 intersecting at right angles a vertical 0.116 inch diameter circular passage 76. Circular, flat ended tuning stubs 78 and 80 are selectively positioned, respectively, in passages 74 and 76 adjacent to the intersection for RF tuning of the energy passing through in the $TM_{01}$ mode. Passage 76 terminates in a choke 82 formed in block 70 in a position corresponding to the end of passage 64 of the inner housing 18. Passage 74 terminates at the iris of transition iris 30.

In a study of the modal field patterns it was determined that the dominant $TE_{11}$ mode in circular waveguide is analogous to the $TE_{10}$ mode in rectangular waveguide and that a right angle transition between two circular waveguides would convert the $TE_{11}$ mode into the $TM_{01}$ mode. To convert the $TE_{10}$ mode of rectangular waveguide to the $TE_{11}$ mode of circular waveguide an inline junction of the two waveguides is needed. An abrupt junction has about a 2:1 VSWR, although the $TE_{11}$ mode is excited. To improve the VSWR, a quarter wavelength thick matching iris is provided at both ends of the rotary joint for efficient modal transitions. The iris is an improvement over known irises as it combines small size with the easy to build features necessary at millimeter wavelengths. The first circular waveguide is inline with the rectangular waveguide and converts the $TE_{10}$ mode in the rectangular waveguide to the $TE_{11}$ mode in the first circular waveguide. The right angle transition to the second circular waveguide converts the $TE_{11}$ mode of the first circular waveguide to the $TM_{01}$ mode in the second circular waveguide, and the second iris converts the $TE_{11}$ mode to the $TE_{10}$ mode for the rectangular waveguide.

To keep the $TM_{01}$ circular waveguide section in scale with other rotary joint designs, the duplex bearing pair is mounted outside the rotary joint. This physically limits the rotary joint to a scan angle of 140 degrees. The RF choke between rotating and stationary parts is a groove shaped and dimensioned as to impede the passage of guided waves with the 94 GHz range. The tuning stubs are flattened circular plugs with radial chokes to minimize contact loss and RF leakage.

Figure 6A:
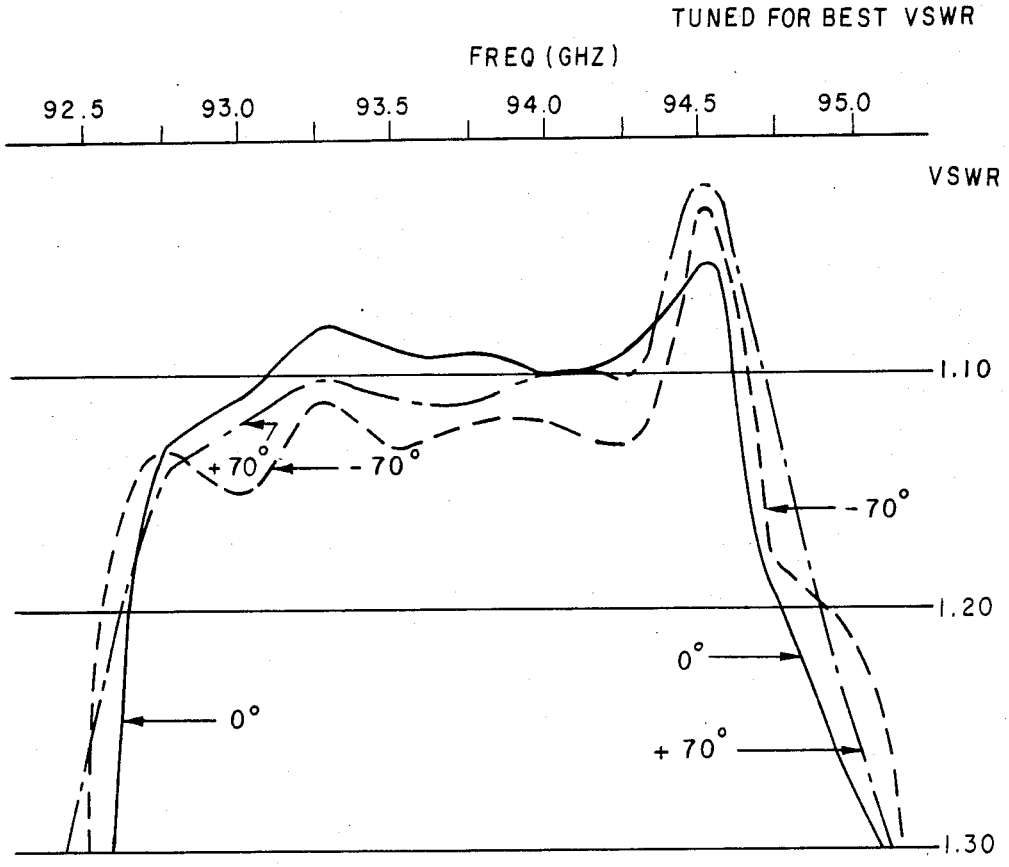
FIGS. 6*a*–6*b* are charts showing, respectively, the VSWR and insertion loss when the rotary joint is tuned for best VSWR.
Figure 6B:
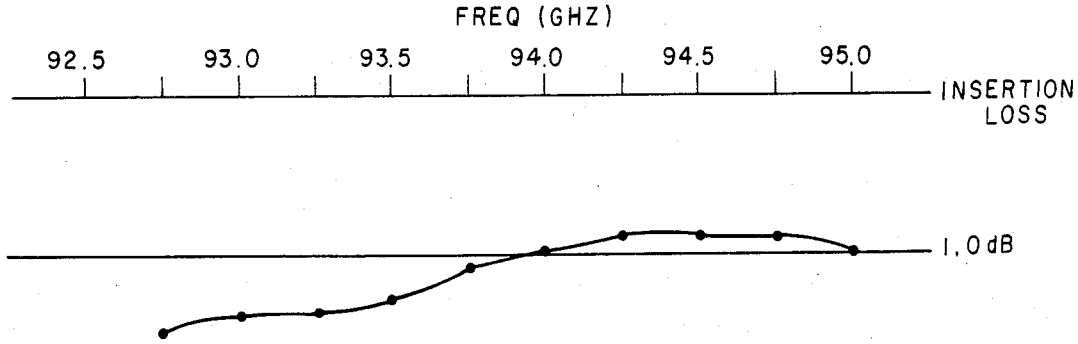
Figure 7A:
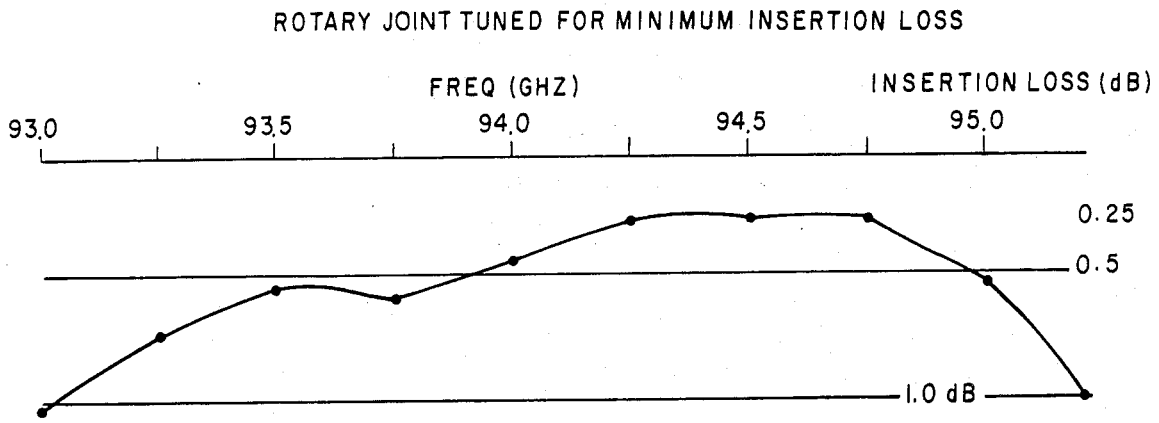
FIGS. 7*a*–7*b* are charts showing, respectively, the insertion loss and VSWR when the rotary joint is tuned for minimum insertion loss.
Figure 7B:
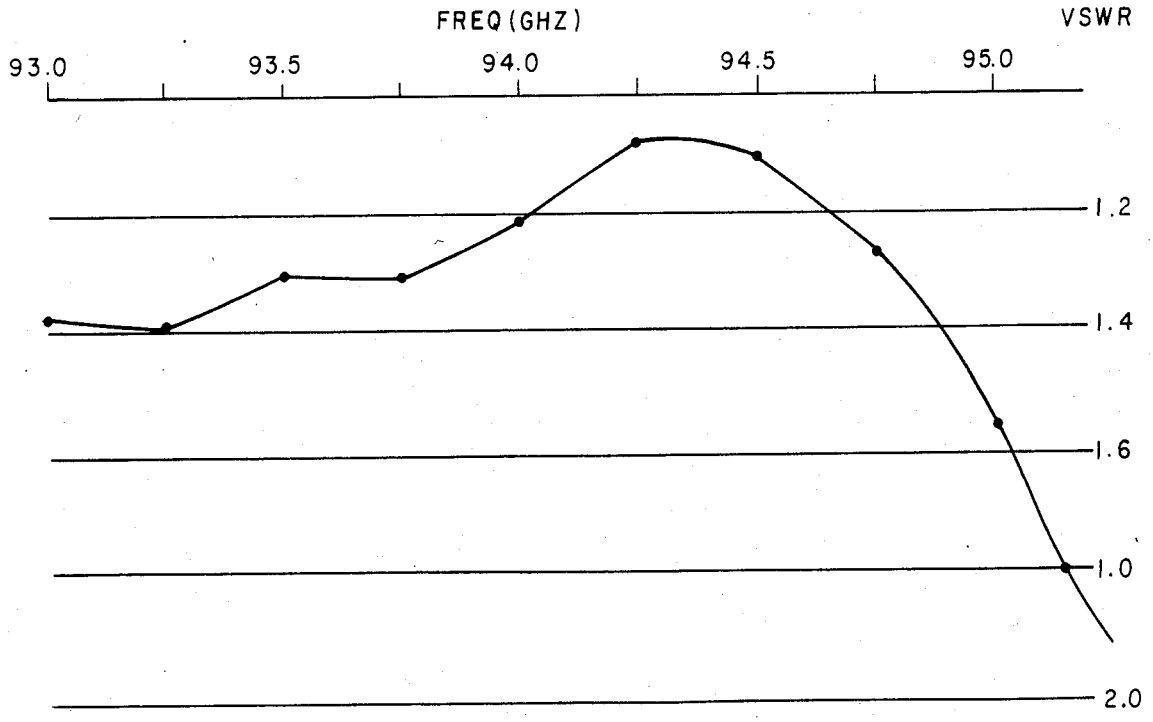

The insertion loss of the rotary joint is very sensitive to the tuning stub positions, and the best case VSWR positions do not coincide exactly with the positions for minimum insertion loss. The VSWR was tuned to less than 1.2 over a 2 GHz bandwidth (2%) (FIGS. 6*a* and 6*b*). At this VSWR the insertion loss was not minimal. Thus, to obtain minimum insertion loss (FIGS. 7*a* & 7*b*) the tuning stubs were moved slightly to get minimum insertion loss with some degradation in VSWR.

The rotary joint is constructed of aluminum with an interior coating of a chromate conversion coating (such as Allodine 1500 sold by Amchem Products Incorporated) rather than coin-silver waveguide because the difference in insertion loss is minimal. Operation over a 1.5% bandwidth should be achievable with less than 0.5 dB insertion loss across the band.

Further it should be possible to achieve 360 degrees rotation by increasing the length of the $TM_{01}$ circular waveguide section to provide bearing clearance. Also, with the circular waveguide passages open at the ends, the tuning stubs can be threaded to enable tuning with a screwdriver.

Although several embodiments of this invention have been described, it will be apparent to a person skilled in the art that various modifications to the details of construction shown and described may be made without departing from the scope of this invention.

What is claimed is:

1. A radar rotary joint comprising: first circular waveguide having a right angle shape for converting a first dominant mode of electromagnetic energy propagation to a second dominant mode of electromagnetic energy propagation;

second circular waveguide also having a right angle shape for converting the second dominant mode of electromagnetic energy propagation to the first dominant mode;

a transition means operatively connecting the second circular waveguide to the first circular waveguide for coupling the second dominant mode of the first circular waveguide to the second dominant mode of the second circular waveguide, the transition means includes rotatable mounting means for rotatively mounting the first circular waveguide to the second circular waveguide wherein an angle made between the first circular waveguide and the second circular waveguide may be rotatively varied.

2. The radar rotary joint according to claim 1 wherein the first and second circular waveguides each further include: an inline junction means operatively connected for connection to a dissimilar waveguide having a third dominant mode for propagating of electromagnetic energy, the inline junction means being for converting the third dominant mode of the dissimilar waveguide to the first dominant mode.

3. The radar rotary rotary joint according to claim 2 wherein the first circular waveguide section includes an inner housing having walls forming the first dominant mode circular waveguide and the second dominant mode circular waveguide, and a bearing supporting surface, said circular waveguides intersecting at right angles for forming a right angle transition of the transition means and including tuning stubs for tuning the first and second circular waveguides, bearings mounted on the bearing support surface, a bearing outer housing for enclosing the outer surface of the bearings, and bearing retainer means secured to the inner housing and bearing outer housing for retaining the bearings; and said second circular waveguide section includes an outer housing operatively connected to the bearing outer housing and having walls forming a a first dominant mode circular waveguide and a a second dominant mode circular waveguide, and a choke in the bottom surface circumscribing the end of the second dominant mode circular waveguide, said first and second dominant mode circular waveguides intersecting at right angles for forming a corresponding right angle transition of the transition means and including tuning stubs for tuning the waveguides whereby the inner housing converts from the first dominant mode to the second dominant mode while the outer housing rotates with respect to the inner housing with the first and second dominant mode circular waveguides in a corresponding relationship.

4. The radar rotary joint according to claim 3 wherein the inner and outer houses are aluminum housings and the walls forming the circular waveguides are coated with a chromate conversion coating.

5. The radar rotary joint according to claim 3 wherein the circular waveguides have a diameter of about 0.116 inches.

6. The radar rotary joint according to claim 2 wherein the inline junction means is an iris, ¼ wavelength thick, and having walls forming an orifice for converting the third dominant mode to the first doninant mode.

7. The radar rotary joint according to claim 6 wherein the orifice comprises a first opening centrally disposed in the iris said first opening includes a centrally disposed circular hole having a preselected diameter and radius and a pair of circular holes each having a predetermined radius and diameter and the pair of circular holes being located left and right of the center of the centrally disposed circular hole said pair of holes having their centers offset from the center of the centrally disposed hole a preselected amount less than the preselected radius of the centrally disposed circular hole and the predetermined diameters less than the preselected diameter of the centrally disposed circular hole whereby the predetermined diameters of the pair of holes overlap the preselected diameter of the centrally dispose circular hole to form a single apertured iris for converting the third dominant mode to the first dominant mode.

8. The radar rotary joint according to claim 7 wherein the diameter of the centrally disposed hole is about 0.082 inches and the pair of left-right holes have diameters of 0.052 inches with centers offset 0.031 inches from the center of the centrally disposed circular hole.

9. The radar rotary joint according to claim 6 wherein the plate is an aluminum plate and the walls forming the iris are coated with chromate conversion coating.

* * * * *